United States Patent [19]

Nonini

[11] Patent Number: 5,056,345

[45] **Date of Patent: * Oct. 15, 1991**

[54] ROLLING STAND WITH ROLLING RINGS SUPPORTED AS A CANTILEVER AND HAVING THEIR AXES AT AN ANGLE TO EACH OTHER

[75] Inventor: Geremia Nonini, Buttrio, Italy

[73] Assignee: Danieli & C. Officine Meccaniche SpA, Italy

[ * ] Notice: The portion of the term of this patent subsequent to Oct. 16, 2007 has been disclaimed.

[21] Appl. No.: 559,078

[22] Filed: Jul. 30, 1990

Related U.S. Application Data

[63] Continuation-in-part of Ser. No. 309,194, Feb. 13, 1989, Pat. No. 4,962,655.

[30] Foreign Application Priority Data

Feb. 25, 1988 [IT] Italy ..... 83324 A/88

[51] Int. Cl.[5] ..... B21B 37/08; B21B 31/26; B21B 31/30

[52] U.S. Cl. ..... 72/21; 72/244

[58] Field of Search ..... 72/21, 244, 237, 243, 72/240, 199

[56] References Cited

U.S. PATENT DOCUMENTS

| | | | |
|---|---|---|---|
| 1,069,072 | 7/1913 | Noll | 72/226 |
| 1,085,568 | 1/1914 | Knights | 72/246 |
| 3,491,571 | 1/1970 | O'Brien | 72/244 |
| 3,818,742 | 6/1974 | Maltby | 72/237 |
| 3,964,282 | 6/1976 | Stubbs | 72/237 |
| 4,751,837 | 6/1988 | Bohnenkamp | 72/244 |

FOREIGN PATENT DOCUMENTS

| | | | |
|---|---|---|---|
| 191451 | 1/1967 | U.S.S.R. | 72/244 |
| 792568 | 3/1958 | United Kingdom . | |
| 1240659 | 7/1971 | United Kingdom . | |

*Primary Examiner*—Daniel C. Crane

*Attorney, Agent, or Firm*—Wegner, Cantor, Mueller & Player

[57] ABSTRACT

Rolling stand with rolling rings supported as a cantilever and having their axes at an angle to each other for the rolling of metallic products, the axes of the rolling rings being horizontal, vertical or tilted, the stand comprising shafts (16) to bear the rolling rings (10) with at least a first bearing (12) and a second bearing (13), at least one pair of the first and second bearings (12-13) being lodged in an eccentric support suitable to adjust the distance between centers of the rolling rings (10), the axes (15) of the rolling rings (10) coinciding with the axes (15) of the respective shafts (16), in which stand the axes (15) of the rolling rings (10) in a non-rolling condition form between them a predetermined angle (alpha) and converge on a position outside and in form of the rolling rings (10).

14 Claims, 4 Drawing Sheets

FIG. 6a
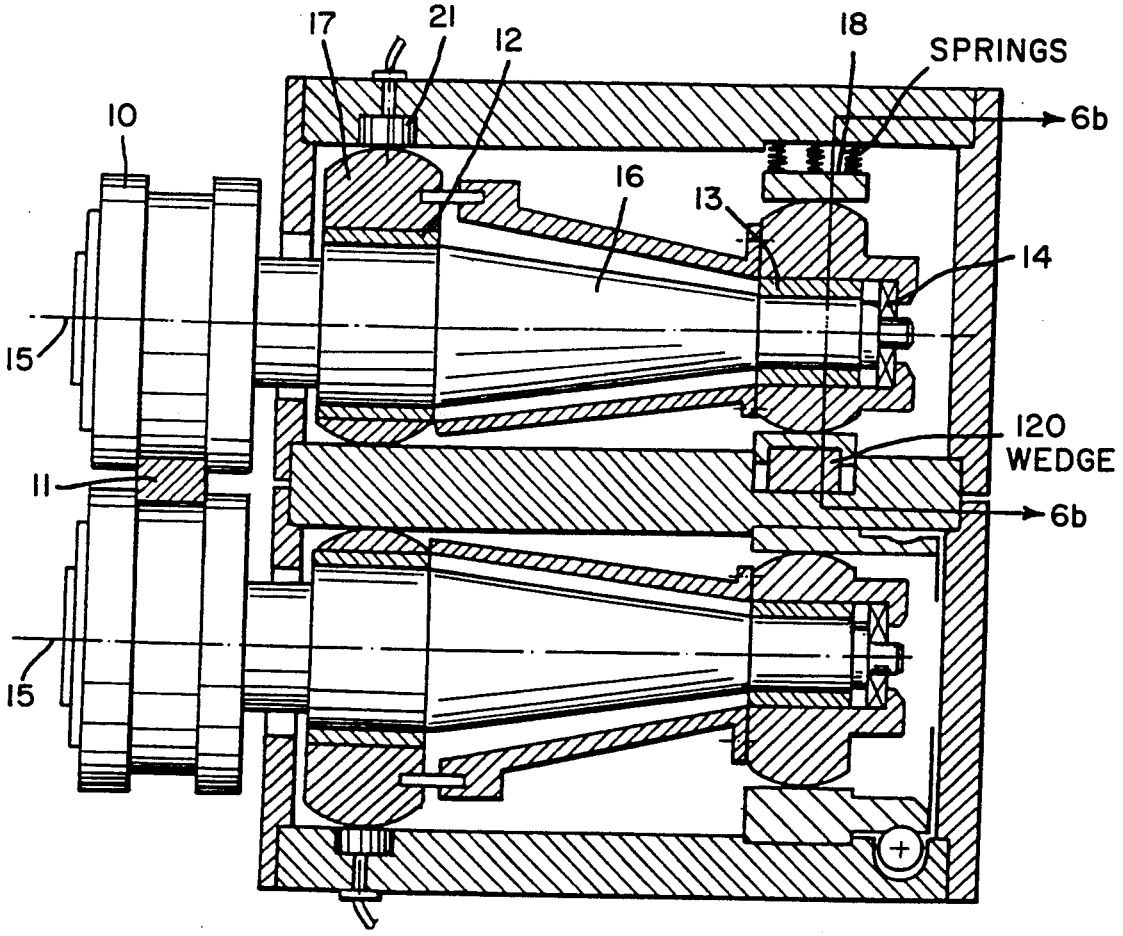
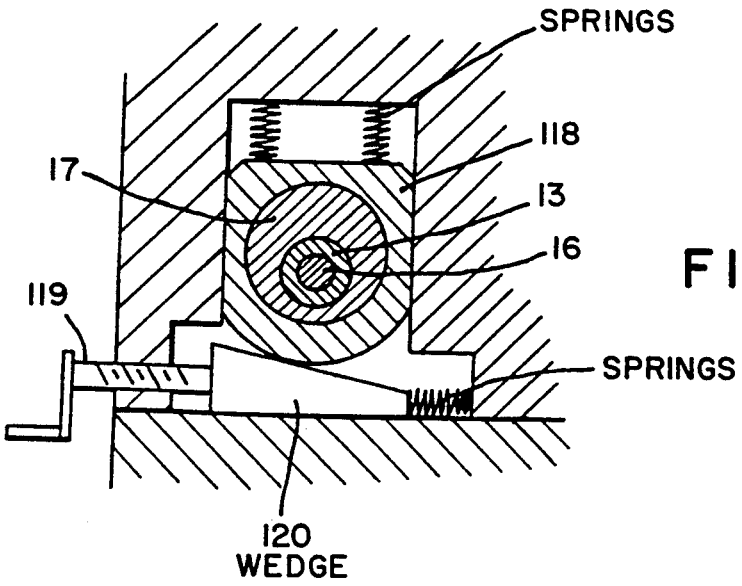
FIG. 6b

ROLLING STAND WITH ROLLING RINGS SUPPORTED AS A CANTILEVER AND HAVING THEIR AXES AT AN ANGLE TO EACH OTHER

This application is a continuation-in-part of Ser. No. 7/309,194 filed Feb. 13, 1989, now U.S. Pat. No. 4,962,655, issued Oct. 16, 1990.

This invention concerns a rolling stand with rolling rings supported as a cantilever and having their axes at an angle to each other for the filling, advantageous hot rolling, or metallic products.

To be more exact, the invention concerns a rolling stand with rolling rings supported as a cantilever, the shafts bearing the rings not being parallel or not being always parallel.

The invention is applicable to rolling stands with the axes of the cantilever-wise rolling rings horizontal, vertical or tilted.

The known rolling stands have the axes of the shafts bearing the rolling rings substantially parallel. During rolling the shafts bend and the rings are displaced by a given angle so that their respective axes in fact diverge.

To avoid such shortcomings, many contrivances are employed such as the reinforcement of the shaft at the cantilever portion holding the rolling ring, the strengthening of the shaft between the two bearings of the stand, the enlargement of the first bearing of the stand, etc.

Thus efforts have been made by way of designing and dimensioning to obviate a typical, characteristic shortcoming of any beam supported at two or more points and stressed with a given weight or force.

Even with the contrivances obtained in the state of the art the rolling rings undergo a widening owing to the high rolling pressures used in modern rolling plants.

Although such widening is rather limited at present, it leads to problems regarding quality, finish and safety.

GB 792,568 discloses a rolling stand with rolling rings supported as cantilevers, the axes of the rings lying at a suitable, selected angle to each other. This angle is fixed and serves only to enable two independent motors to be positioned.

GB 1,240,659 teaches the adjustment of the angle between the axes of rolling rolls supported as cantilevers. This adjustment serves only to adjust the working gap between the rolls, so that a given gap corresponds to a given angle and viceversa.

The present applicant has designed, tested and embodied this invention to obviate such shortcomings and obtain a plurality of advantages, and in a variant this invention is applied correctly in conjunction with the teaching of IT 1187546.

A rolling stand with rolling rings supported as a cantilever and having their axes at an angle to each other according to the invention is represented and characterized in the main claim and dependent claims.

According to the invention the shafts supporting the rolling rings as a cantilever are fitted at an initial angle which leads their axes to converge on a position outside the rings.

According to a variant this initial angle can be obtained as desired and modified in steps so as to suit, with each step of modification, a given range of products to be rolled.

For instance, the angle "alpha" will be equal to "x" and be suitable for rods having a diameter ranging from 1 to 15 mm and will be calculated for about the requirements of the mean value, namely 12 mm, of the diameter of the product to be rolled.

For a range of 15 to 18 mm the angle "alpha" will be equal to "y", which will be greater than "x" and be characteristic of the median value of the range in question, and so on for the various ranges which can be envisioned as the extent of each single step of values.

Thus, for a range of rods from 6 to 20 mm we may have from two to seven or more steps of adjustment, each step being characterized advantageously by about the mean value.

According to a further variant the variation of the angle is graduated as required and is continuous, being obtained with continuous adjustment means.

According to yet another variant, which can be combined with the others, the adjustment of the angle can be made functional by the rolling factor.

Such adjustments made functional by the rolling factor can be obtained, for instance, by providing load cells, which by means of a processing system to determine in steps or continuously in real time or compensated time the optimum angle for the shafts to take up.

This means that the angle may vary with variations in the properties of the material to be rolled or in the geometric characteristics of the section to be rolled.

Variation of the angle may take place by acting on both shafts or on one single shaft.

Moreover, the adjustment can be made by acting on the first bearing of the stand, namely the bearing nearest to the rolling rings, or on the second bearing, that is, the bearing farthest from the ring.

According to the invention the optimum angle between the two shafts will vary as a function of the rolling stand, of the properties of the material to be rolled, of the geometric characteristics of the shafts and of the chemical and physical properties of the shafts.

The angle may carry from 20 seconds up to about 2°.

The angle "alpha" may have as its bisector the plane passing along the center line of the section being rolled.

According to a variant the bisector of the angle "alpha" does not pass along the center line of the section being rolled.

The invention arranges, therefore that where the distance between centers of the rings has to be adjusted, that adjustment will be independent of the angular adjustment existing between the axes of the rings so as to compensate for the above bending problems.

The attached figures, which are given as a non-restrictive example, show the following:

Figure 4:
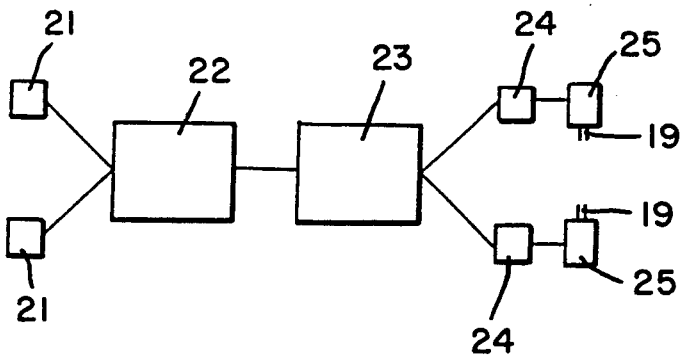

FIG. 4 gives a diagram of a system for continuous adjustment.

Figure 5:
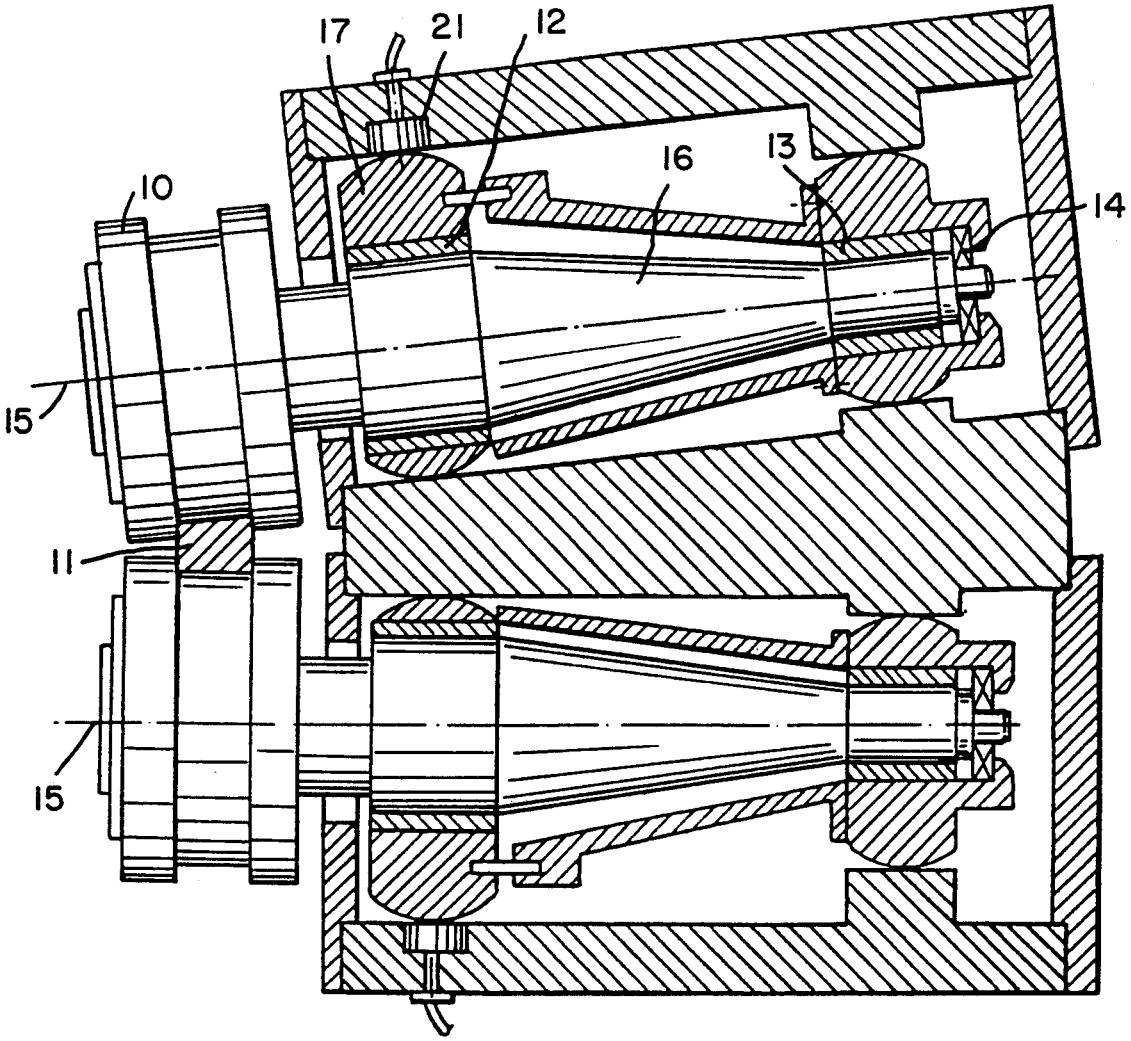

FIG. 5 shows an elevational cross-sectional view of another embodiment of the invention;

FIG. 6*a* shows an elevational cross-sectional view of yet another embodiment of the invention;

FIG. 6*b* shows a cross-sectional view of still another embodiment of the invention taken along line 6*b*—6*b* of FIG. 6*a*.

Figure 1:
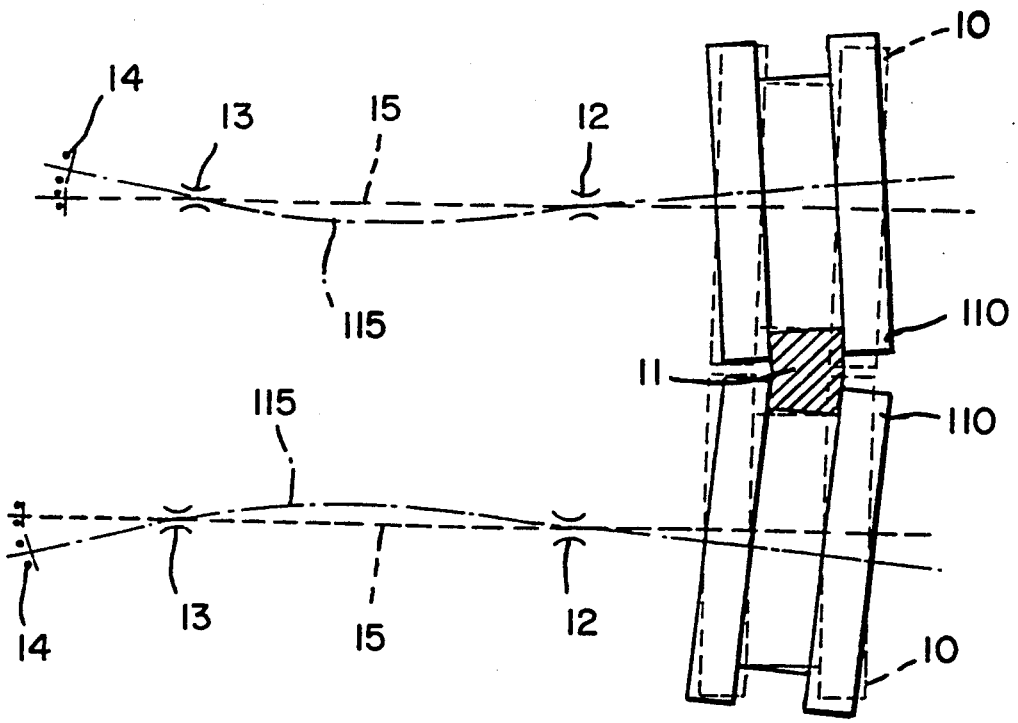
FIG. 1 shows the present state of the art in an exaggerated and stylized form.

In FIG. 1 during an inactive, non-working phase rolling rings coincide with the axes of shafts 16 (see FIG. 3) which cooperate with a first bearing 12, a second bearing 13 and advantageously with a thrust bearing 14.

During the processing of a section 11 the rolling thrust tends to separate the rings 10, which take up a position 110. At the same time the shafts 16 bend and deform the axes 15 according to the position 115.

As is clear, during their working step the rolling rings 110 are no longer in the best geometric condition.

Figure 2:
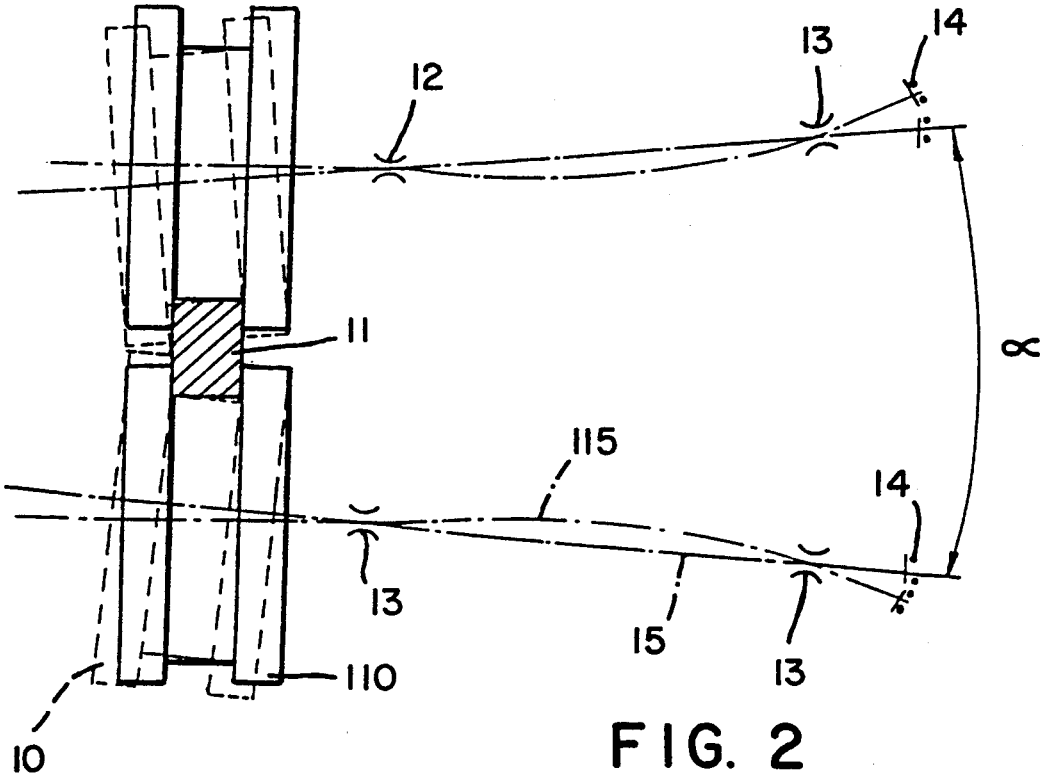
FIG. 2 shows the invention in an exaggerated and stylized form.

FIG. 2 gives a deformed and amplified diagram of the idea of the solution. This figure show that at the beginning the axes 15 of the shafts 16 supporting the rolling rings 10 are positioned at an angle "alpha" to each other.

When the stand is not working and the rolling rings 10 are only rotating, they are located in the position 10. When the stand is rolling the section the rolling rings 10 are displaced and take up the position 110, and their axes 15 are deformed and take up the position 115.

Owing to the initial angle "alpha" the rings 10 under load take up the position 110, which is the optimum position. The angle "alpha" may be not variable or be variable in steps or continuously.

Variation in steps can be provided, for instance, by means of threaded shafts or wedges or jacks or other means, which act on the first bearing 12 or second bearing 13 of the stand.

According to a preferred but not exclusive embodiment the adjustment is performed on the second bearing 13.

Adjustment in steps can be obtained also, for instance, by means of supports with a differentiated eccentricity of lodgement, the supports serving to uphold and lodge the housing of the second bearing 13.

Continuous variation can be obtained with threaded shafts, eccentric sleeves, wedges, etc., acting on the first 12 or second 13 bearing, advantageously but not exclusively on the second bearing 13.

Figure 3:
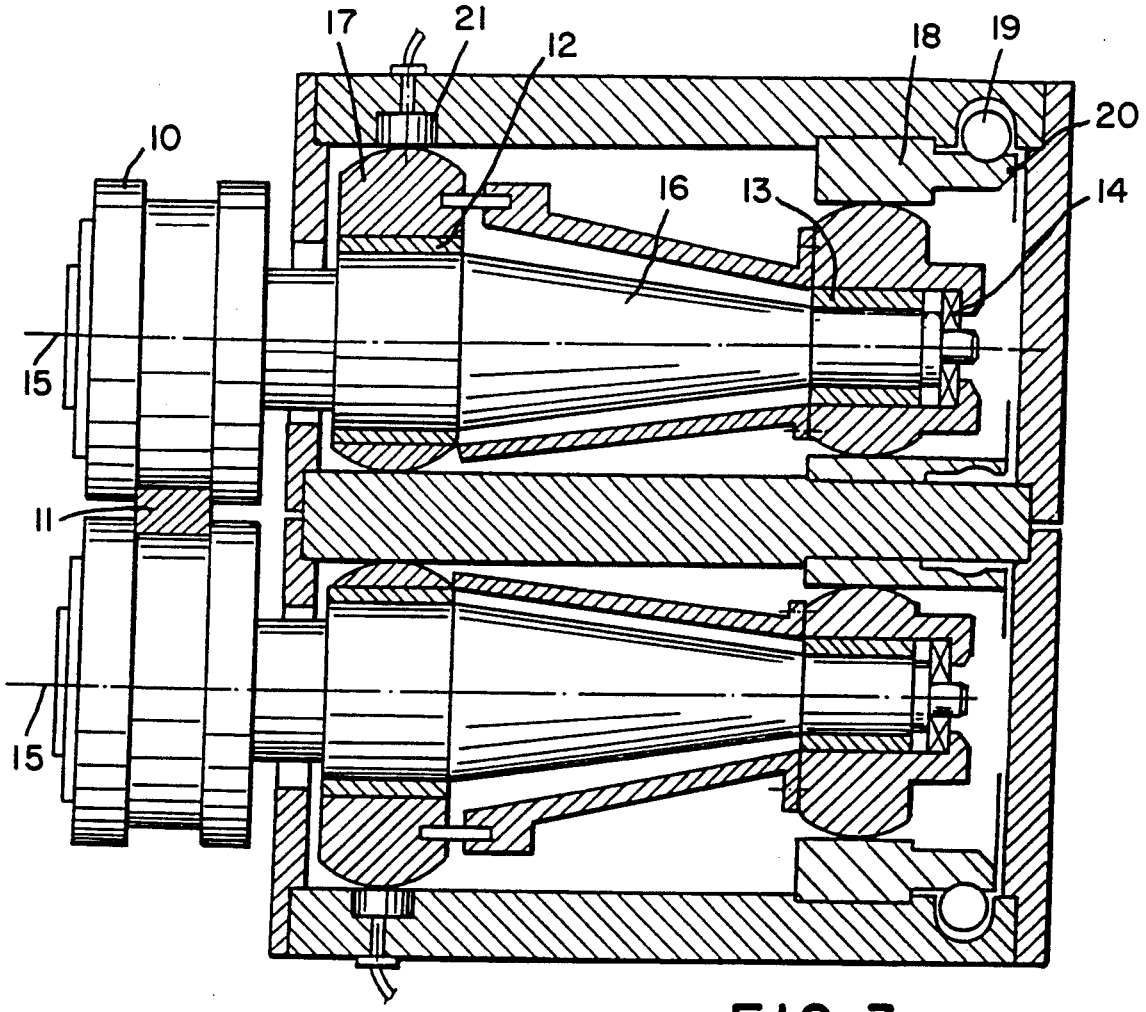
FIG. 3 shows and elevational cross-sectional view of a first embodiment of the invention.

FIG. 3 shows a diagrammatic example of the invention, in which there is adjustment of the distance between centers of the rings and of the angle between the axes of the rings. In this figure the shaft 16 cooperates with first and second bearings 12–13, which are held and supported in a housing 17 that facilitates adaptation to deformations of the shaft 16.

This housing is the subject of a specific right of the present applicant.

In the case in question the part of the housing which cooperates with the second bearing 13 is lodged and supported on an eccentric sleeve 18 that can rotate as required owing to the action of a worm screw 19 on a threaded portion 20 forming an integral part of the eccentric sleeve 18.

According to a variant the eccentric sleeve 18 can act instead on the first bearing 12 or, in another variant, two eccentric sleeves 18 could be included, one of them acting on the first bearing 12 while the other acts on the second bearing 13.

As we said earlier, instead of the eccentric sleeve 18 there could be provided threaded shafts, wedges, jack, etc., according to the design requirements.

FIG. 5 shows an example of the invention, in which the predetermined angle (alpha) is not variable. This is accomplished by removing eccentric sleeve(s) 18, one of which is shown in FIG. 3, and positioning shafts 16 with their axes at angle alpha to each other. Therefore, a fixed angle alpha is provided by designing the stand in such a way that the axes 15 of the shafts 16 generate the angle alpha. FIGS. 6(*a*) and 6(*b*) show an example of the invention, where instead of the eccentric supports 18, a wedge or wedges 120 are provided which, by moving axially with adjustment means 119, change the angle alpha. While FIG. 6 shows the wedge acting only on the upper shaft, the invention provides for the wedge to act on either one or both shafts. Further, the wedge can act on the bearing 12 or, the second bearing 13 or, a plurality of wedges may be employed to act on both. The springs provide elastic control for the thrusting of wedge 120. Advantageous control over the angle alpha can therefore be maintained at the high rates of modern rolling speeds.

According to a further variant the housing 17 or another suitable part cooperates with means 21 that monitor the rolling stress, for instance with a load cell.

Instead of the load cell 21, a signal correlated with the rolling thrust can also be taken form the motor of the rolling stand or from the means which actuate the motor of the stand. This signal is received by a data receiver integrator assembly 22 (see FIG. 4) and is then processed by a data processor 23 before being sent to the motor 25, for instance, through suitable signal adapter means 24. The motor 25 drives the worm screw 19.

Variations detected by the monitor 21 can be adapted advantageously to avoid hurried adjustments or adjustments depending on peaks or other random factors.

We claim:

1. A rolling stand for rolling metallic products, comprising:

a plurality of rolling rings for forming said metallic products;

a plurality of rolling ring shafts supported as a cantilever, supporting said plurality of rolling rings, and each having an axis of rotation coinciding with an axis of rotation of a rolling ring; and a plurality of bearings rotatably supporting said plurality of rolling ring shafts;

said rings are unsupported about their circumferences and the bearings are positioned on said shafts so that during operation of said rolling stand, said plurality of rolling ring shafts are resiliently bent due to resistance to deformation of said metallic products so that the axes of rotation of said plurality of rolling rings are in an optimum orientation;

wherein an angle exists between said axes of rotation of each said plurality of rolling rings such that said axes of rotation converge at a point in front of said rolling stand while the rolling stand is idle, said angle compensating for the bending of the rolling ring shafts during operation of said rolling stand, further comprising wedge means to effectuate adjustment of said angle.

2. A rolling stand as claimed in claim 1, wherein a bisector of said angle passes substantially along a center line of the metallic product being rolled between said rolling rings.

3. A rolling stand as claimed in claim 1, wherein a bisector of said angle runs outside and displaced in relation to the center line of metallic product being rolled between said rolling rings.

4. A rolling stand as claimed in claim 1, wherein said angle is greater than twenty seconds and less than 2°.

5. A rolling stand as claimed in claim 1, wherein said angle is fixed after adjustment.

6. A rolling stand as claimed in claim 1, wherein the angle can be varied in steps.

7. A rolling stand as claimed in claim 1, wherein the size of the angle depends on the properties of the material to be rolled.

8. A rolling stand as claimed in claim 1, wherein the angle is continuously variable.

9. A rolling stand as claimed in claim 1, wherein adjustment of the angle is accomplished by displacement of a first bearing.

10. A rolling stand as claimed in claim 9, having two bearings.

11. A rolling stand as claimed in claim 1, further comprising threaded shafts to effectuate adjustment of said angle.

12. A rolling stand as claimed in claim 1, further comprising eccentric supports to effectuate adjustment of said angle.

13. A rolling stand as claimed in claim 12, wherein said eccentric supports are rotary eccentric sleeves.

14. A rolling stand as claimed in claim 1, further comprising means to monitor the rolling stress and control adjustment of said angle.

* * * * *